US006115851A

United States Patent [19]

Maseruka

[11] Patent Number: 6,115,851

[45] Date of Patent: Sep. 12, 2000

[54] TOILET FLUSHING APPARATUS

[76] Inventor: Geoffrey Maseruka, P.O. Box 20106, Ottawa, Ontario, Canada, K1N 9N5

[21] Appl. No.: 09/272,345

[22] Filed: Mar. 19, 1999

[30] Foreign Application Priority Data

Apr. 17, 1998 [CA] Canada ..... 2 234 928

[51] Int. Cl.[7] ..... E03D 5/092

[52] U.S. Cl. ..... 4/249; 4/405

[58] Field of Search ..... 4/249, 405

[56] References Cited

U.S. PATENT DOCUMENTS

| | | | |
|---|---|---|---|
| 4,562,601 | 1/1986 | Aflitto | 4/249 |
| 4,847,924 | 7/1989 | Samaniego | 4/249 |
| 5,056,165 | 10/1991 | Westcott, Sr. | 4/249 |
| 5,068,925 | 12/1991 | Salibi | 4/249 |
| 5,142,708 | 9/1992 | Johnson et al. | 4/249 |
| 5,170,513 | 12/1992 | Ambooken et al. | 4/249 |
| 5,491,848 | 2/1996 | Wang | 4/405 |
| 5,553,334 | 9/1996 | Hillman | 4/249 X |

*Primary Examiner*—Robert M. Fetsuga

[57] ABSTRACT

A toilet flushing aid for use with a toilet having a flushing handle. The toilet flushing aid has a first actuating member adapted for actuation by an elbow of a user; a second actuating member adjacent the toilet and adapted for actuation by movement towards the toilet by a foot of a user; a rigid support member interconnecting the first and second actuating members; and a connection member for operatively connecting the aid to the toilet.

19 Claims, 2 Drawing Sheets

TOILET FLUSHING APPARATUS

TECHNICAL FIELD

The present invention relates to an aid for the actuation of a conventional toilet flush handle.

More particularly, the present invention relates to an elbow and/or foot actuated device to permit the depression and thus actuation of a conventional toilet flush handle.

BACKGROUND ART

U.S. Pat. No. 5,170,513 discloses a toilet flushing aid which is actuated by a foot pedal arrangement. The apparatus includes an elongated cord connected at one end to the flush mechanism of a toilet tank and connected at the other end to a foot pedal arrangement which is positioned on the floor. A person utilizing this device must depress the foot pedal mechanism by a downward pressure of their foot thereon to thus actuate the flushing mechanism.

U.S. Pat. No. 5,068,925 discloses an apparatus for adapting hand actuated toilet flushing mechanisms to a foot actuated flushing means. The device includes a handle extension means which slides over the handle of an existing flushing element. A connecting rod extends from the handle extension at one end and connects to a foot pedal at the other end. Again, a person must depress the foot pedal by a downward pressure with their foot to actuate the flushing mechanism.

U.S. Pat. No. 4,847,924 also relates to a toilet flushing aid which involves a foot pedal arrangement. Brief downward pressure on the foot pedal transmits vertical motion (by way of a cable element) to a activating member located just above the existing flush handle. When the foot pedal is activated, the activating member engages and depresses the existing flush handle of the toilet.

U.S. Pat. No. 4,562,601 relates to a toilet flushing aid for use with a conventional flush handle of a toilet. The device of this patent is releasably attached to an existing flush handle and includes an elongated lever means and a lever actuation end. The device is actuated by a downward pressure of a user's elbow on the actuating end which actuates the conventional flushing handle.

SUMMARY OF THE INVENTION

The present invention provides a flushing aid which enables one to flush the toilet in an easy manner. More particularly, the flushing aid of the present invention is designed in such a manner to permit a user, and particularly a disabled user, to flush the toilet in a simple and hygenic manner. Depending an a person's preference and abilities, they can either flush the toilet using an elbow or a foot.

With the device of the present invention, it is not necessary for a user to use his/her hands to flush the toilet and this has advantages with respect to hygiene and allows a disabled person who might not have full use of their hands, such as for example due to arthritis or other deabilitating conditions, to readily flush the toilet in a comfortable and independent manner. Further, such a device would be of benefit to a person suffering from back pain as they would not have to twist and reach behind them in order to flush the toilet.

The flushing device contemplated by the present invention has the further advantage that it can be readily and easily installed on the existing flushing mechanism of most conventional toilets and works in conjunction therewith.

In accordance with an embodiment of the present invention there is provided a toilet flushing aid for use with a toilet having a flushing handle. The toilet flushing aid comprises a first actuating means overlying at least a portion of the flushing handle and adapted for actuation by an elbow of a user and a second actuating means adjacent the toilet and adapted for actuation by movement towards the toilet by a foot of a user. A rigid support means is provided for operatively interconnecting said first and second actuating means; and connection means are provided for connecting the aid to the flush handle.

Preferably, the first actuating means has a generally L-shaped configuration and is of a dimension to overlie at least a major portion of the flushing handle.

The second actuating means is preferably in the form of a generally vertically oriented rectangular plate and is spaced from the floor a distance which would enable comfortable and easy actuation by a person's foot.

In preferred embodiments, the rigid support means which connects the first and second actuating means is essentially diagonally oriented.

It is particularly preferred that the flushing aid by of a one-piece integral construction.

The flushing aid may be made of any suitable material. Examples of the types of materials which could be utilized are any suitable plastic or metal; although it will be understood that any other suitable material could be used.

Preferably, the support means includes an aperture at an upper end thereof which facilitates its ready and easy connection to the existing hardware of a toilet.

Another embodiment of the present invention provides for an improved toilet where the toilet has a tank portion and a flushing handle. The improvement comprises the provision of an elbow actuation member overlying at least a portion of said flushing handle, a foot actuation member adjacent to a lower portion of said toilet, and a rigid support member operatively connecting said elbow actuation member and said foot actuation member.

If desired a spacer element could be utilized between the tank and the flushing aid of the present invention to space the flushing aid further from the tank.

BRIEF DESCRIPTION OF THE DRAWINGS

Having thus generally described the invention, reference will now be made to the accompanying drawings wherein.

DETAILED DESCRIPTION

Figure 1:
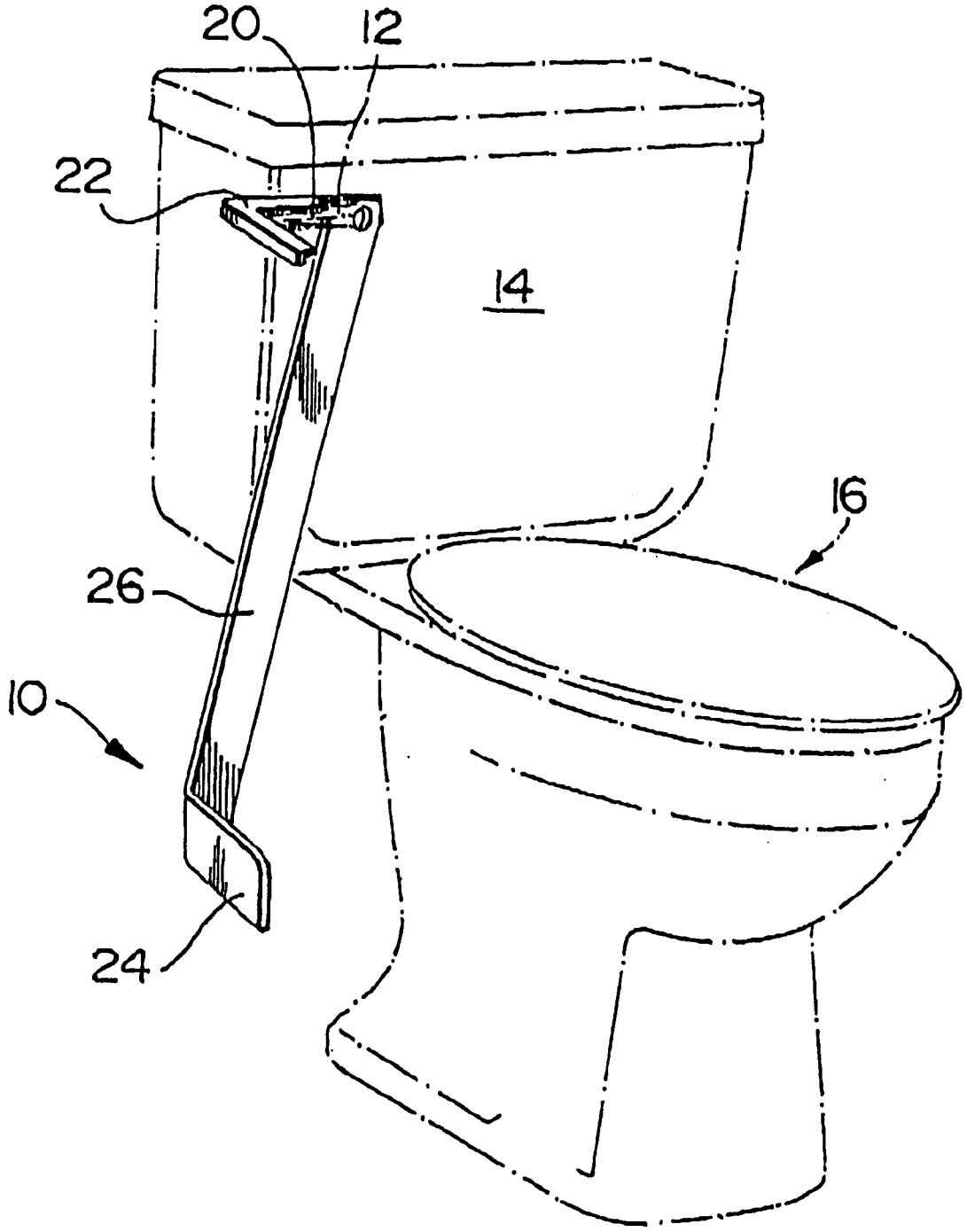
FIG. 1 is a perspective view of the flushing aid of the present invention installed on a conventional toilet.

As illustrated in FIG. 1, the flushing aid 10 of the present invention is affixed to the existing flush handle 12 located on the tank 14 of a conventional toilet 16.

Figure 2:
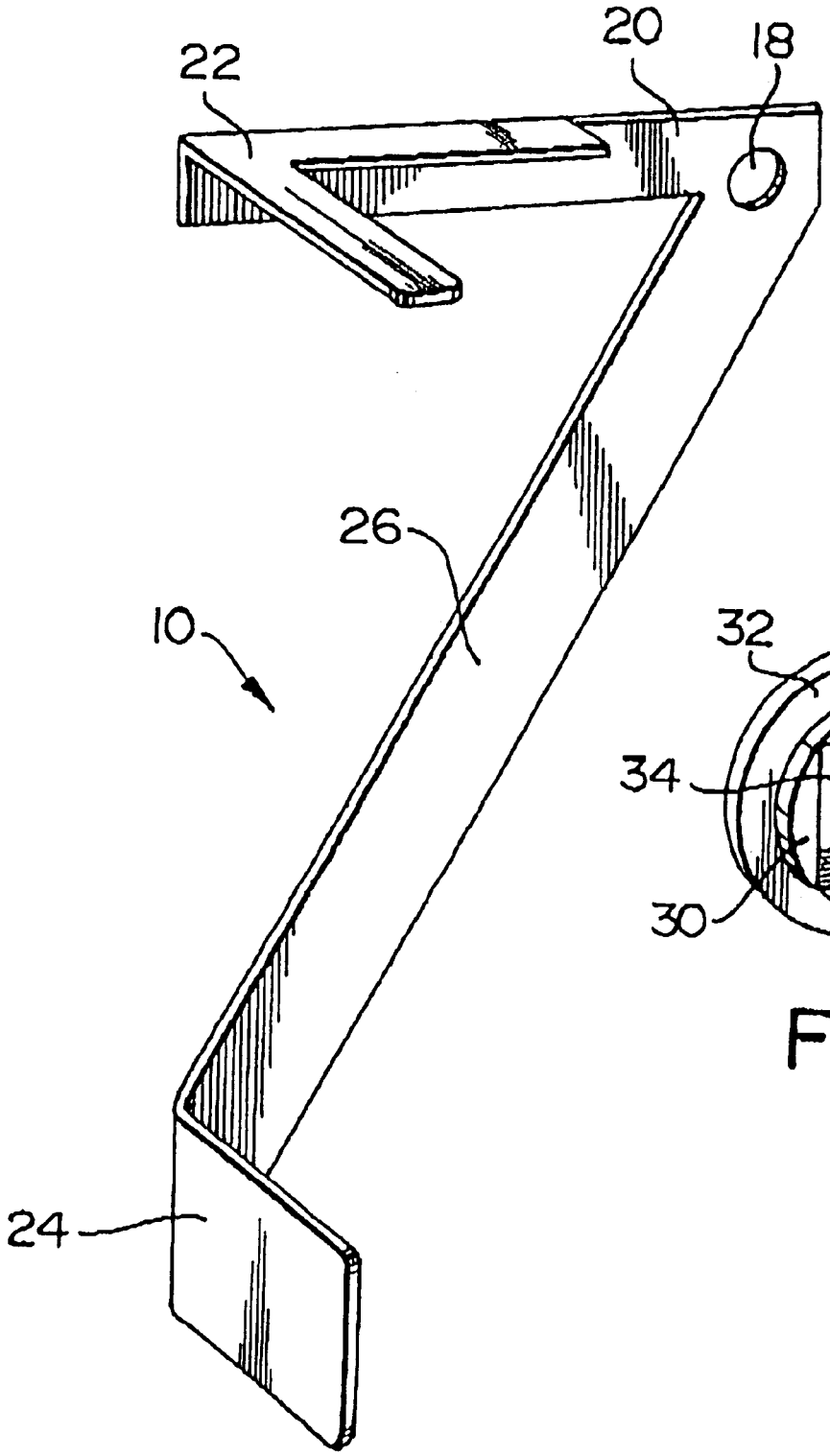
FIG. 2 is a perspective view of the flushing aid of the present invention.

As best illustrated in FIG. 2, the flushing aid 10 includes a connection means in the form of an aperture 18 for affixing the aid to the existing hardware of a conventional toilet. There is a first upper generally horizontal arm 20 which includes a flanged portion 22 which extends outwardly therefrom. The flanged portion 22 overlies at least a portion of the existing flush handle of a toilet and is of a dimension suitable for elbow actuation.

In the embodiment illustrated in the drawings, the flanged portion 22 has a generally L-shaped configuration. It will be understood that various configurations or dimensions can be utilized for the flanged portion 22 and the L-shaped configuration is illustrated only as one example of the various arrangements which can be utilized.

The flushing aid 10 is also provided with a foot actuated portion 24 which is located spaced from the floor at a convenient location for actuation by a user's foot.

In the illustrated embodiment the foot actuated portion 24 is generally rectangularly shaped and vertically oriented. As will be appreciated, various shapes and configurations could be utilized without departing from the scope of the present invention.

The foot actuated portion 24 and the flanged portion 22 are joined by way of an elongated support member 26 which extends between the two portions 22, 24. In the preferred form illustrated, the elongated support member 26 extends from flanged portion 22 in a generally diagonal manner to the foot actuated portion 24.

Preferably, the flushing aid 10 is composed of a rigid plastics material. Alternatively, the flushing aid 10 can be of a metal or any other suitable rigid material.

The flushing aid 10 is preferably of a one-piece integral construction and includes reinforcing or strengthening means on the elongated support member 26. Such reinforcing or strengthening means may be in the form of ribs as illustrated.

The preferred method of affixing the flushing aid to the existing toilet is to remove the conventional toilet flush handle 12, place the aperture I8 of the flushing aid 10 over the connector and reattach the convention handle.

In use a person can either flush the toilet using the flushing aid 10 with a downward pressure on the flanged portion 22 by an arm/elbow or by a push of the foot actuated portion 24 inwardly towards the toilet 16.

The downward pressure on the flanged portion 22, by a person's elbow, results in a downward pressure on the existing conventional flush handle 12 and thus the flushing of the toilet.

By pressing inwardly with one's foot on the foot actuated portion 24, this also causes the flanged portion 22 to exert a downward force on the existing conventional flush handle 12 and thus results in the flushing of the toilet.

Figure 3:
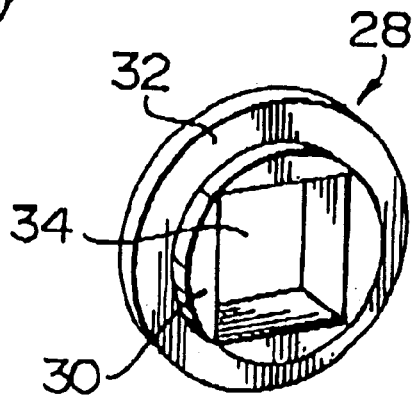
FIG. 3 is a spacer element according to the present invention.

If desired, one could also space the flushing aid 10 a distance from the tank 14 by use of a spacer element 28 which may be utilized on the existing flushing handle connecting hardware between the toilet flushing aid 10 and the tank 14. One form of such a spacer element 28 is illustrated in FIG. 3 and includes a washer like element 28 having a generally square aperture 34 which is adapted to fit on existing hardware of the existing flushing mechanism. The spacer element 28 further includes a round protruding element 30 which fits into the aperture 18 of the flushing aid 10. Preferably the spacer element 28 has a total thickness in the range of about 2 to 5 mm. Such a device would aid in preventing the rubbing of the flushing aid 10 against the tank 14 when used.

Further, it will be appreciated that, if desired, the toilet flushing aid of the present invention can replace the existing flushing handle altogether.

Having now described the invention, in its preferred form, it will readily be apparent and understood that various modifications and alterations can be made without departing from the scope and spirit of the invention.

I claim:

1. A toilet flushing aid for use with a toilet having a flushing handle, comprising:

a first actuating means to overlie at least a portion of said flushing handle and adapted for actuation by an elbow of a user;

second actuating means adapted to be positioned adjacent the toilet and adapted for actuation by movement towards the toilet by a foot of a user;

rigid support means interconnecting said first and second actuating means; and connection means for operatively connecting said aid to said flushing handle.

2. A toilet flushing aid as claimed in claim 1, wherein said first actuating means has a generally L-shaped configuration.

3. A toilet flushing aid as claimed in claim 1, wherein said first actuating means is of a dimension to completely overlie said flushing handle.

4. A toilet flushing aid as claimed in clam 1, wherein said second actuating means is in the form of a generally vertically oriented rectangular plate.

5. A toilet flushing aid as claimed in claim 1, wherein said rigid support means is generally diagonally oriented.

6. A toilet flushing aid as claimed in claim 1, wherein said aid is a integral one-piece plastic member.

7. A toilet flushing aid as claimed in claim 1, wherein said connection means is in the form of an aperture at an upper end of said support means.

8. In a toilet flushing devices the improvement comprising:

a generally horizontal elbow actuation member, a foot actuation member adapted for actuation by a pushing movement towards a toilet;

rigid support means operatively interconnecting said elbow actuation member and said foot actuation member;

connection means for operatively connecting said device to a toilet.

9. A toilet flushing device as claimed in claim 8, wherein said elbow actuation member is in the form of an L-shaped member.

10. A toilet flushing device as claimed in claim 8, wherein said actuating member is of a dimension to completely overlie an existing flushing handle on a toilet.

11. A toilet flushing device as claimed in claim 8, wherein said foot actuation member is in the form of a generally vertical oriented rectangular plate.

12. A toilet flushing device as claimed in claim 8, wherein said support means is generally diagonally oriented.

13. A toilet flushing device as claimed in claim 8, wherein said device is an integral one-piece plastic member.

14. A toilet flushing device as claimed in claim 8, wherein said connection means is in the form of an aperture at an upper end of said support means.

15. In a toilet having a tank portion with a flushing mechanism and connection means for connecting said flushing mechanic to said tank, the improvement wherein said flushing mechanism comprises an elbow actuation member, a foot actuation member adjacent to a lower portion of said toilet, and a rigid support member operatively connecting said bow actuation member and said foot actuation member, and wherein said elbow actuation member is a generally horizontal L-shaped member.

16. A toilet as claimed in claim 15, further including a spacer element for spacing said flushing mechanism outwardly from said tank portion.

17. A toilet as claimed in claim 15, wherein said foot actuation member is a generally vertically oriented rectangular plate.

18. A toilet as claimed in claim 15, wherein said rigid support means is generally diagonally oriented.

19. A toilet as claimed in claim 15, wherein said flushing mechanism is an integral one-piece plastic member.

* * * * *